United States Patent [19]

Anderson et al.

[11] Patent Number: 4,683,657

[45] Date of Patent: Aug. 4, 1987

[54] CUTTING BLADE FOR CARPET REMOVING MACHINES

[76] Inventors: Lloyd E. Anderson, 6408-74th Ave. N.; Martin L. Anderson, 4417 Third St. NE., both of Minneapolis, Minn. 55428

[21] Appl. No.: 838,154

[22] Filed: Mar. 10, 1986

[51] Int. Cl.[4] ..... A47L 11/12

[52] U.S. Cl. ..... 30/170; 30/335; 15/93 R; 299/37

[58] Field of Search ..... 30/169, 170, 171, 172, 30/136, 136.5, 335; 15/93 R; 299/37

[56] References Cited

U.S. PATENT DOCUMENTS

| | | | |
|---|---|---|---|
| 2,545,827 | 3/1951 | Posey | 15/93 R |
| 2,806,283 | 9/1957 | Brennan | 30/335 X |
| 3,695,713 | 10/1972 | Rothi et al. | 15/93 R X |
| 4,162,809 | 7/1979 | Anderson et al. | 15/93 R X |
| 4,549,350 | 10/1985 | Patillo | 30/170 |

*Primary Examiner*—E. R. Kazenske
*Assistant Examiner*—Michael D. Folkerts
*Attorney, Agent, or Firm*—Orrin M. Haugen; Thomas J. Nikolai; Frederick W. Niebuhr

[57] ABSTRACT

A cutting attachment for a carpet stripping tool whereby the carpeting being removed from a floor area is simultaneously cut into strips as the adhesive bond between the carpet and the floor is separated.

1 Claim, 4 Drawing Figures

CUTTING BLADE FOR CARPET REMOVING MACHINES

BACKGROUND OF THE INVENTION

I. Field of the Invention:

This invention relates generally to tools for removing worn carpeting from a floor surface, and more particularly to an attachment for an existing power stripper machine whereby the carpeting being removed is cut through the thickness dimension thereof as the stripping machine separates the old carpeting from the floor.

II. Discussion of the Prior Art:

The Anderson et al U.S. Pat. No. 4,162,809 entitled "OSCILLATING CARPET AND TILE STRIPPER" describes a power carpet and tile stripping machine which is sold by applicant's assignee under the trademark BEAR CAT®. This machine includes a wide, somewhat elongated blade which is supported for oscillating orbital movement in a plane which makes a slight angle to the horizontal with the driving force for the blade being provided by an electric motor. The tool is utilized by first lifting the worn carpeting at some point and inserting the blade of the power stripper on the floor, the sharpened front edge of the floor-engaging blade being guided along the floor so as to act upon the adhesive which had been used to bond the carpeting or tile to the floor. It is found, however, that when used for removing carpet, the operation is enhanced if the carpeting is first cut into narrow strips before the power stripper machine is used.

The prior art technique has been to first use a razor knife (utility knife) to cut through the thickness dimension of the carpeting down to the floor along a series of parallel lines of appropriate spacing before the power stripper is employed. When it is recognized that old carpeting is often dirt-ladden and that grit quickly dulls the cutting edge of the utility knife, the cutting operation tends to be both time-consuming and wasteful of cutting blades.

SUMMARY OF THE INVENTION

To obviate the foregoing problems, in accordance with the present invention, a vertically-extending carpet cutting blade is suitably attached to the power-driven, floor-engaging blade of the motorized stripper a short predetermined distance rearward of the working edge of that stripper blade. Thus, as the power-driven stripper blade is reciprocated back and forth along its orbital path to break the adhesive bond between the floor and the worn carpet being removed, the carpet is lifted sufficiently from the floor so as to engage the cutting edge of the vertically disposed cutting blade whereby the carpeting is cut into strips simultaneously with the lifting of the carpet from the floor by the action of the power-driven blade. Furthermore, the oscillatory impact of the power-driven blade against the adhesive interface tends to shake the sand and grit from the carpet fiber so that the vertical cutting blade is not dulled as rapidly as it is when the prior art technique described above is utilized.

OBJECTS

Accordingly, it is a principal object of the present invention to provide a new and improved attachment for a motor-driven carpet removal machine.

Another object of the invention is to provide an attachment for a carpet removing machine which makes it unnecessary to precut the carpet to be removed into strips.

A still further object of the invention is to provide a carpet cutting attachment for a motor-driven carpet stripper which cuts the carpet as it is lifted from the floor.

Yet another object of the invention is to provide a cutting blade adjustably mounted on the motor-driven, floor-engaging blade of a power carpet stripper to allow the position of the cutting blade to be set to accommodate carpets of differing thickness.

Yet still another object of the invention is to provide a mounting arrangement for a cutting blade to be attached to a power stripper such that the cutting blade can be readily removed and replaced when it becomes dull.

These and other objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
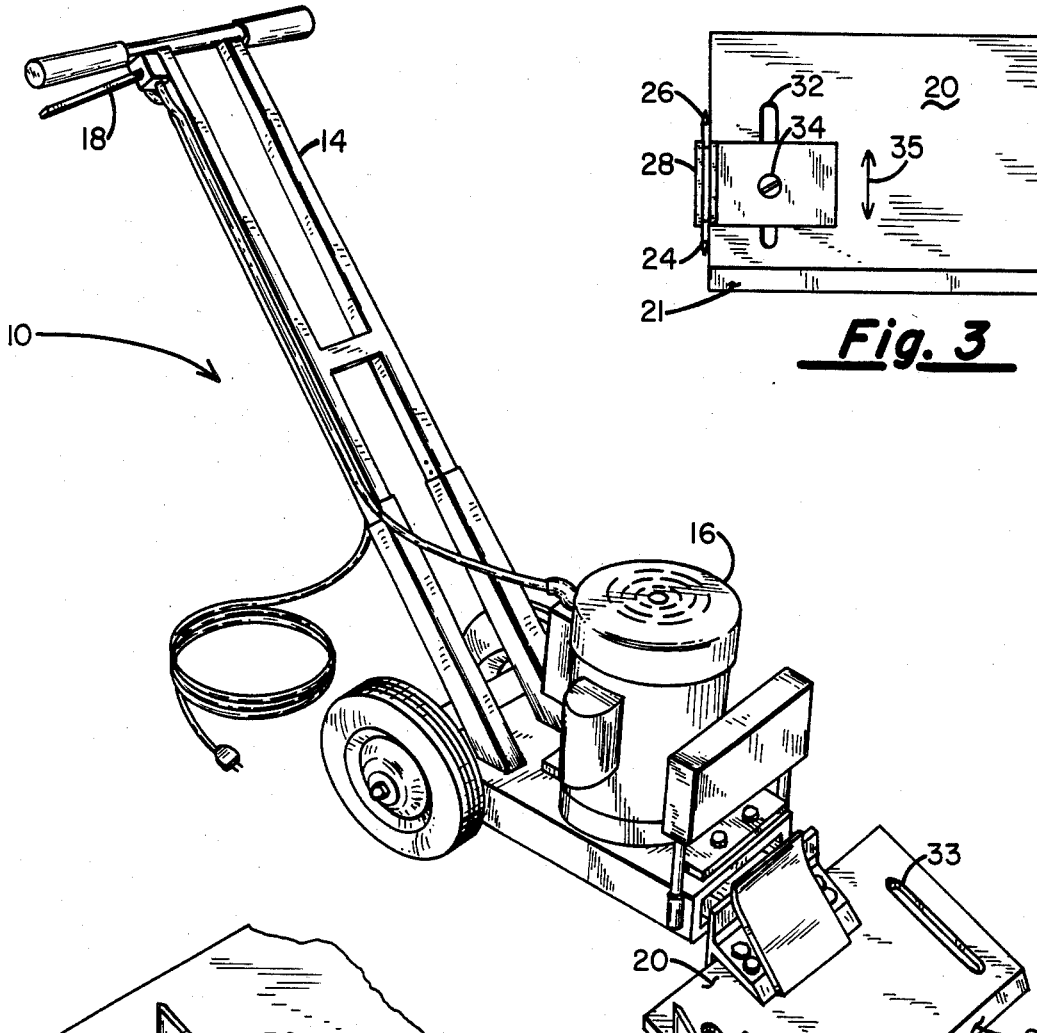
FIG. 1 is a perspective drawing of the power stripper incorporating the cutting attachment of the present invention.

Referring to FIG. 1, identified by numeral 10, is a power tile/carpet stripper of a type manufactured and sold by National Carpet Equipment Company of Minneapolis, Minnesota, and which is more particularly described in U.S. Pat. No. 4,162,809. It is seen to comprise a wheel-supported base 12 which can be steered or manipulated by an operator in a standing position by virtue of an upwardly extending handle 14. Mounted on the base 12 is a motor 16, the energization of which can be controlled by a hand lever 18 mounted on the upper-portion of the handle.

As is fully explained in the aforereferenced patent, beneath the base 12 is an eccentric which is secured to the shaft of the motor 16 and the eccentric is arranged to drive the blade 18 to give it an orbital motion. The front edge of the blade that is intended to interact with the interface between the tile or carpet and the floor 20 has a chisel edge. During the orbital travel of this blade, it repeatedly strikes and cuts the interface, breaking the adhesive bond and loosening the carpet.

It has been found that the carpet stripper device thus far described works more readily to remove carpeting from the floor if the carpet is cut into strips, the strips being approximately as wide as the width of the blade 20. Therefore, it has been the practice in the past to first use a utility knife or the like and run it over the carpet to cut through the thickness dimension thereof along a series of parallel, spaced-apart lines. Once so cut, the power stripper is then used to separate the carpet from the floor.

In accordance with the present invention, however, there is provided a cutting blade assembly, indicated generally by numeral 22, which attaches to the edge of the stripper blade 20 in an adjustable manner so that the carpeting is cut into strips as the stripping machine is used to separate the carpeting from the underlying floor surface.

Figure 3:
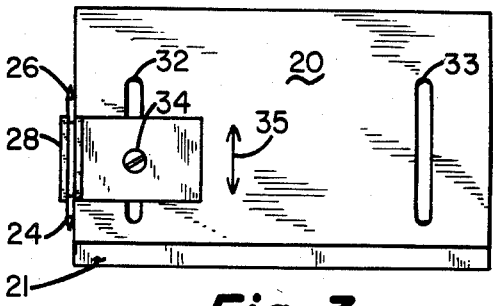
FIG. 3 is a top view of the stripper blade with the present invention attached.
Figure 2:
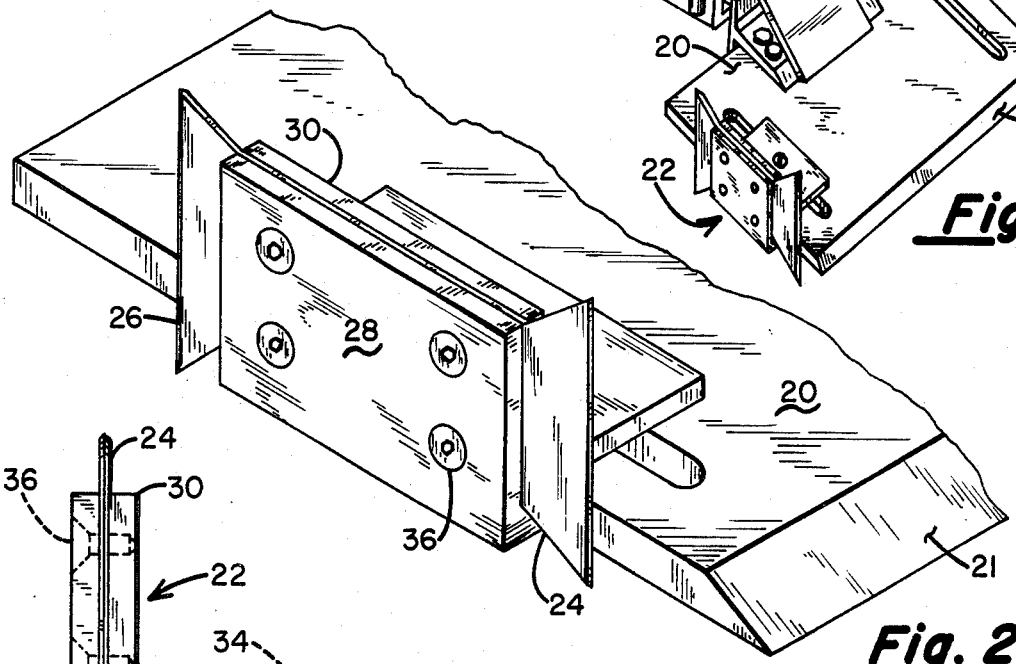
FIG. 2 is an enlarged perspective view of the blade member of the machine of FIG. 1 to which the cutting attachment of the present invention is attached.
Figure 4:
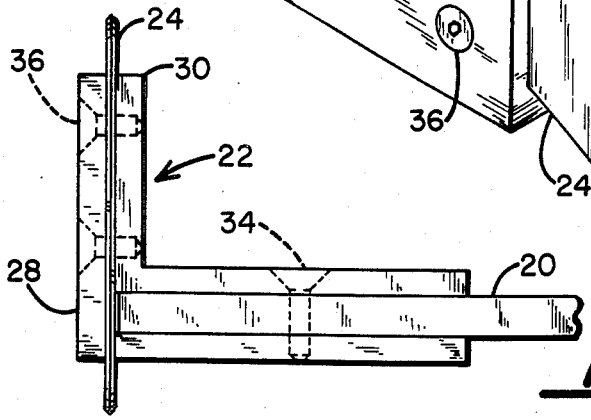
FIG. 4 is a front view of the device of FIG. 2.

As can be seen in FIG. 2, the cutting blade assembly 22 comprises one or more blades as at 24 and 26 which are contained in a mounting bracket comprising lower and upper L-shaped bracket members 28 and 30. As shown in FIGS. 3 and 4, the upper bracket member 30 has one leg thereof abutting the upper surface of the blade 20 while the lower bracket member 28 also has one leg abutting the undersurface of the blade 20. Formed through the thickness dimension of the blade is an elongated slot 32 and a screw 34 extends through a hole in the upper bracket 30 and the slot 32 into a threaded hole in the lower bracket member 28.

Next, with reference to FIGS. 2 and 3, it can be seen that the trapezoidal-shaped utility blades 24 and 26 have their unsharpened edges fitted between the portions of the brackets 28 and 30 which extend perpendicular to the blade 20. Clamping screws, as at 36, are threaded into threaded apertures formed through the thickness dimension of the upstanding legs. In this fashion, the blades 24 and 26 are held with their honed edges facing to the front and to the rear.

Adjustability in the blade positioning is permitted in that by loosening the screw 34, the bracket assembly 22 can be moved toward and away from the chisel edge 21 of the blade 20, as indicated by the arrow 36, before it is again firmly secured by tightening the screw 34. Similarly, the cutting blade 24 may be raised and lowered to ensure that the carpeting being stripped will be appropriately cut by the blades as the stripping machine 10 is pushed along the floor with the blade 20 moving in its orbital path by adjusting the blade 24 height while clamping screws 36 are loose and then tightening those screws again.

When the leading cutting blade, such as 24 in FIG. 2, has become dulled through use, the screw 34 may be removed and the bracket assembly 22 moves to the opposite side edge of the blade 20 and, in this fashion, it will now be blade 26 which would be the leading edge engaging the carpeting being cut. Again, the bracket assembly is held in position by slipping the blade 20 between the upper and lower bracket members and then passing the holding screw 34 through these brackets and through the elongated slot 33.

As already mentioned in the introductory portion of the specification, the cutting blades 24 and 26 tend to remain sharp for longer periods than when blades of this type are used in utility knives when the cutting of the carpet into strips is done in a manual fashion. This is because the oscillating motion of the stripper blade 20 engaging the adhesive bond between the carpeting and the floor tends to rapidly shape the carpeting being removed so that sand and grit contained in the carpet fibers falls away before the cutting blade 24 does its work.

Those skilled in the art will visualize various changes and modifications which can be made to the invention, especially in the way that the cutting blades 24 and 26 are held in their perpendicular relationship along the side edge of the stripper blade 20. It is contemplated that all changes and modifications which fairly fall within the scope of the appended claims, as reasonably interpreted, should be included within the protection afforded by this patent.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A worn carpet removal machine comprising, in combination:

(a) a motorized carpet stripper machine having a generally flat, rectangular, floor-engaging blade member with a chisel-shaped cutting edge formed on the working surface thereof and mounted for oscillating orbital motion with said floor engaging blade at a predetermined angle relative to the horizontal; and (b) a cutting blade having a sharpened edge, said cutting blade being adjustably secured to said floor-engaging blade and having a portion extending vertically upwardly therefrom and a portion extending vertically downwardly therefrom at generally a right angle and located adjacent a side edge thereof with said sharpened edge pointing toward and of an adjustable distance from said chisel-shaped cutting edge of said floor-engaging blade, said cutting blade operative to slice through the thickness dimension of the carpet as it is loosened from the floor by said floor-engaging blade with said predetermined angle precluding the downwardly extending portion of said cutting blade from contacting the floor.

* * * * *